US006667732B1

(12) United States Patent
Katase

(10) Patent No.: US 6,667,732 B1
(45) Date of Patent: Dec. 23, 2003

(54) METHOD OF DRIVING LIQUID CRYSTAL DEVICE, LIQUID CRYSTAL DEVICE, AND ELECTRONIC INSTRUMENT

(75) Inventor: Makoto Katase, Hotaka-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/701,336

(22) PCT Filed: Mar. 31, 2000

(86) PCT No.: PCT/JP00/02066

§ 371 (c)(1),
(2), (4) Date: Nov. 27, 2000

(87) PCT Pub. No.: WO00/58777

PCT Pub. Date: Oct. 5, 2000

(30) Foreign Application Priority Data

Mar. 31, 1999 (JP) ..... 11-094067

(51) Int. Cl.[7] ..... G09G 3/20; G09G 3/36; G09G 5/10

(52) U.S. Cl. ..... 345/103; 345/58; 345/690

(58) Field of Search ..... 345/58, 94, 95, 345/98, 100, 103, 690, 691, 204; 359/55; 349/107, 151

(56) References Cited

U.S. PATENT DOCUMENTS

| | | | | |
|---|---|---|---|---|
| 5,093,736 A | | 3/1992 | Iijima | |
| 5,627,558 A | * | 5/1997 | Hotto | 345/94 |
| 5,734,364 A | * | 3/1998 | Hirai et al. | 345/95 |
| 5,739,803 A | * | 4/1998 | Neugebauer | 345/100 |
| 5,767,836 A | * | 6/1998 | Scheffer et al. | 345/690 |
| 5,861,869 A | * | 1/1999 | Scheffer et al. | 345/691 |
| 5,953,002 A | * | 9/1999 | Hirai et al. | 345/204 |
| 6,232,944 B1 | * | 5/2001 | Kumagawa et al. | 345/58 |

FOREIGN PATENT DOCUMENTS

| | | | | |
|---|---|---|---|---|
| JP | A-63-304294 | | 12/1988 | |
| JP | A-3-20714 | | 1/1991 | |
| JP | A-8-234704 | | 9/1996 | |
| JP | 08-234704 | * | 9/1996 | 345/58 |

OTHER PUBLICATIONS

Ruckmongathan, "A Generalized Addressing Technique for RMS Responding Matrix LCDs", *1988 International Display Research Conference*, pp. 80–85.
Display Research Conference, pp. 80–85.

* cited by examiner

*Primary Examiner*—Bipin Shalwala
*Assistant Examiner*—Prabodh M. Dharia
(74) *Attorney, Agent, or Firm*—Oliff & Berridge, PLC

(57) ABSTRACT

A liquid crystal device using a simple matrix panel which is driven by seven level potentials including PV3, PV2, PV1, VC, MV1, MV2, and MV3 in 4-line simultaneous selection driving at a high duty $n_1$. The bias ratio $c_1$ at this time is (PV2−VC)/L/PV3. In 4-line simultaneous selection driving at a low duty $n_2$, the liquid crystal device is driven by five levels including PV2, PV1, VC, MV1, and MV2 by stopping the operation of third and fourth voltage raising circuits (230) and (232). The bias ratio $c_2$ at this time is (PV2−VC)/L/PV2. When changing the duty, the relation $n_1 \cdot c_1^2 = n_2 \cdot c_2^2$ is satisfied. This eliminates the need for contrast adjustment each time the duty is changed. A voltage-raising multiplying factor "k" in a third voltage raising circuit (230) satisfies the relation k=PV3/PV2. Therefore, $n_2 = n_1 \cdot (c_1/c_2)^2 = n_1 \cdot (1/k)^2$ is realized.

24 Claims, 12 Drawing Sheets

METHOD OF DRIVING LIQUID CRYSTAL DEVICE, LIQUID CRYSTAL DEVICE, AND ELECTRONIC INSTRUMENT

TECHNICAL FIELD

The present invention relates to a method of driving a liquid crystal device using a simple matrix panel. The present invention also relates to a liquid crystal device and an electronic instrument using the liquid crystal device, such as OA equipment and measuring instruments.

BACKGROUND OF ART

In a liquid crystal device using a simple matrix panel, a method of changing a bias ratio according to the power supply voltage or a method of changing a bias ratio when changing a display duty has been employed. The display duty must be changed when changing from a full screen display to a partial display, for example.

In conventional liquid crystal devices, a maximum voltage in a liquid crystal driving voltage generated by raising the power supply voltage is divided using a resistance dividing circuit, thereby generating various levels of liquid crystal driving voltages.

The bias ratio must be changed when changing the display duty in order to maximize an operation margin. Conventionally, the resistance value of a resistance element in the resistance dividing circuit is designed to be variable. An electric current flowing through the resistance dividing circuit changes when changing the resistance value, whereby the levels of each liquid crystal driving voltage change. Therefore, conventional technology has a problem in that contrast must be adjusted each time the display duty is changed.

Accordingly, an object of the present invention is to provide a method of driving a liquid crystal device which can eliminate the need for adjustment of contrast by the user when changing the display duty, a liquid crystal device, and an electronic instrument.

Another object of the present invention is to provide a method of driving a liquid crystal device which can easily display a partial display and which enables a partial display with low power consumption, a liquid crystal device, and an electronic instrument.

DISCLOSURE OF THE INVENTION

One aspect of the present invention provides, a method of driving a liquid crystal device comprising a first substrate on which a plurality of electrodes are formed, a second substrate on which a plurality of segment electrodes are formed, and a liquid crystal interposed between the first substrate and the second substrate, and applying a voltage which changes into at least an ON voltage and an OFF voltage to a pixel formed at each intersection point of the common electrodes and the segment electrodes, the method comprising:

a first driving step of driving the liquid crystal device under a condition of a first duty and a first bias ratio; and a second driving step of driving the liquid crystal device under a condition of a second duty and a second bias ratio, wherein the first duty and the second duty and the first bias ratio and the second bias ratio are set so that a root-mean-square voltage applied to the pixel when the intermediate voltage between the ON voltage and the OFF voltage is applied to the pixel in the first driving step equals a root-mean-square voltage applied to the pixel when the intermediate voltage between the ON voltage and the OFF voltage is applied to the pixel in the second driving step.

According to this aspect of the present invention, the bias ratio is changed when changing the display duty so that the intermediate values between the ON voltage and the OFF voltage are almost equal. This allows the medium concentration to be almost constant before and after changing the duty. Therefore, the user does not have to adjust the contrast each time the duty is changed.

This aspect of the present invention can be applied to both one-line selection driving and multi-line driving.

Another aspect of the present invention provides, a method of driving a liquid crystal device comprising a first substrate on which a plurality of electrodes are formed, a second substrate on which a plurality of segment electrodes are formed, and a liquid crystal interposed between the first substrate and the second substrate, and applying a voltage which changes into at least an ON voltage and an OFF voltage to a pixel formed at each intersection point of the common electrodes and the segment electrodes, the method comprising:

a first driving step of driving the liquid crystal device under a condition of a first duty $n_1$ and a first bias ratio $c_1$; and a second driving step of driving the liquid crystal device under a condition of a second duty $n_2$ and a second bias ratio $c_2$, wherein the first duty and the second duty and the first bias ratio and the second bias ratio are set to satisfy $n_1-c_1^2=n_2\cdot c_2^2$.

According to this other aspect, the bias ratio is changed from $c_1$ to $c_2$ when changing the display duty from $n_1$ to $n_2$ so that the intermediate values between the ON voltage and the OFF voltage are almost equal. The condition required for this is to satisfy the relation $n_1\cdot c_1^2=n_2\cdot c_2^2$ according to a Ruckmongathan's equation as described later. This aspect can be applied to both one-line selection driving and multi-line driving.

The first driving step may comprise a step of raising a maximum signal potential supplied to the segment electrodes to generate a selection potential to be supplied to the common electrodes. The second driving step may comprise a step of stopping the raising step and supplying the maximum signal potential supplied to the segment electrodes to the common electrodes as the selection potential.

This configuration allows the raising operation can be stopped in the second driving step, thereby reducing power consumption. Moreover, since the potential for the segment electrodes is supplied to the common electrodes, there is no need to generate other liquid crystal drive potentials.

When a voltage-raising multiplying factor is "k" in the raising step performed in the first driving step, the relation $n_2=n_1\cdot(1/k)^2$ may be realized. This is because the bias ratios $n_1$ and $n_2$ and the voltage-raising multiplying factor "k" in the raising step satisfy the relation $c_1/c_2=1/k$.

A further aspect of the present invention provides, a method of driving a liquid crystal device comprising a first substrate on which a plurality of electrodes are formed, a second substrate on which a plurality of segment electrodes are formed, and a liquid crystal interposed between the first substrate and the second substrate, and applying a voltage which changes into at least an ON voltage and an OFF voltage to a pixel formed at each intersection point of the common electrodes and the segment electrodes, the method comprising:

a first driving step of driving the liquid crystal device under a condition of a first duty and a first bias ratio; and a second driving step of driving the liquid crystal device under a condition of a second duty lower than the first duty and a second bias ratio, wherein the first duty and the second duty and the first bias ratio and the second bias ratio are set so that a root-mean-square voltage applied to the pixel when the ON voltage is applied to the pixel in the first driving step is equal to or less than a root-mean-square voltage applied to the pixel when the ON voltage is applied to the pixel in the second step, and a root-mean-square voltage applied to the pixel when the OFF voltage is applied to the pixel in the first driving step is equal to or more than a root-mean-square voltage applied to the pixel when the OFF voltage is applied to the pixel in the second step.

According to this further aspect of the present invention, the bias ratios are selectively changed so that the range between the ON voltage and the OFF voltage at a high duty (first duty) includes the range between the ON voltage and the OFF voltage at a low duty (second duty). This allows the contrast obtained in the low-duty driving to be higher than the contrast obtained in the high-duty driving Therefore, the user does not have to adjust the contrast each time the display duty is changed. This aspect can be applied to both one-line selection driving and multi-line driving.

A liquid crystal device according to a still further aspect of the present invention comprises;

a panel including a first substrate on which a plurality of electrodes are formed, a second substrate on which a plurality of segment electrodes are formed, and a liquid crystal interposed between the first substrate and the second substrate;

a segment driver which supplies a voltage to the segment electrodes;

a common driver which supplies a voltage to the common electrodes; and a power supply circuit which supplies a liquid crystal driving voltage to the common driver and the segment driver, wherein the segment driver includes a circuit of which duty changes between a first duty $n_1$ and a second duty $n_2$ ($n_2<n_1$), wherein the power supply circuit comprises a circuit which sets a bias ratio at a first bias ratio $c_1$ when the first duty $n_1$ is set, and sets a bias ratio at a second bias ratio $c_2$ when the first duty $n_2$ ($c_2>c_1$) is set, and wherein the first duty and the second duty and the first bias ratio and the second bias ratio are set to satisfy $n_1 \cdot c_1^2 = n_2 \cdot c_2^2$.

The drive method according the above-described other aspect of the present invention is suitably applied to this liquid crystal device.

In addition, the common driver and the power supply circuit may be included in a single-chip IC.

An electronic instrument according to still another aspect of the present invention has the above-described liquid crystal device. The liquid crystal device used as a display for the electronic instrument may be driven at a high duty during a normal operation mode, and driven at a low duty when displaying a partial display during a wait mode. In the case of a portable telephone, in particular, power consumption can be reduced by displaying an icon or the like on only part of the display screen in a wait mode without displaying in other areas. The electronic instrument according to the present invention can be applied to any type of electronic instrument which requires partial display in the low-duty driving. The electronic instrument is particularly suitable as a mobile apparatus for which low power consumption is needed.

BEST MODE FOR CARRYING OUT THE INVENTION

The present invention will be described below with reference to drawings.

Outline of Example Device

A liquid crystal device to which a drive method as described later is applied will be described.

Figure 9:
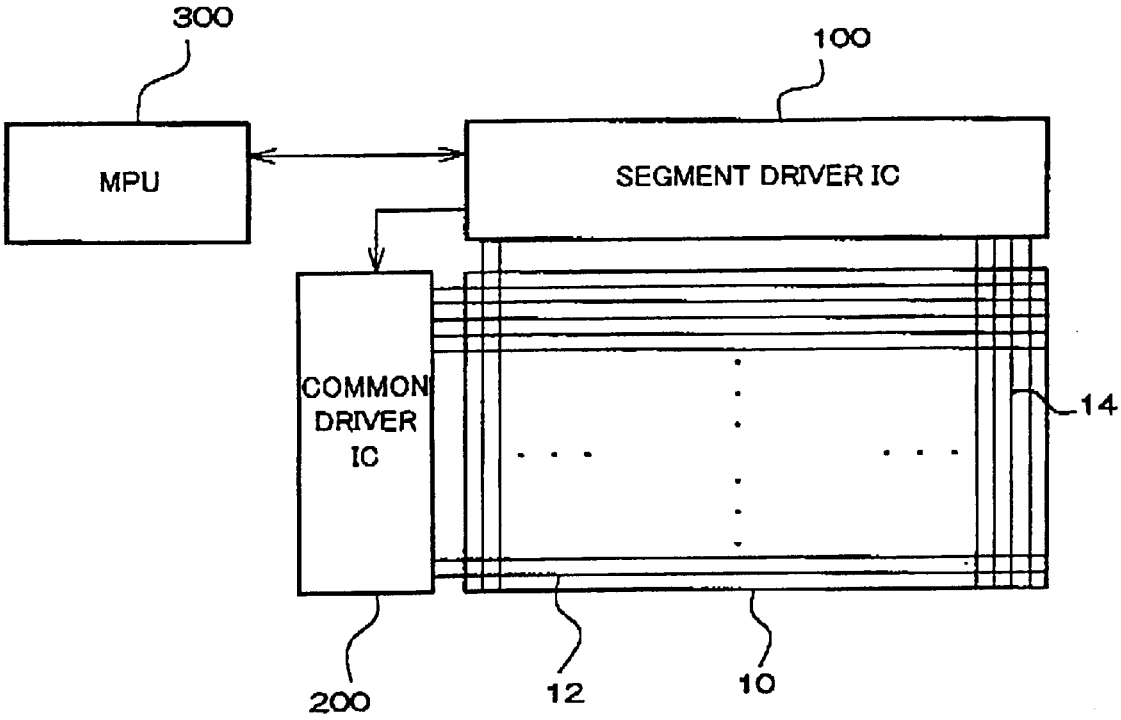
FIG. 9 is a view schematically showing a liquid crystal device used in each embodiment of the present invention.

FIG. 9 shows a simple matrix panel 10. The panel 10 has a first substrate (not shown) with common electrodes 12 formed thereon, a second substrate (not shown) with segment electrodes 14 formed thereon, and liquid crystals (not shown) interposed between the first substrate and the second substrate.

A common driver IC 200 which drives the common electrodes 12, a segment driver IC 100 which drives the segment electrodes 14, and an MPU 300 which outputs commands and data to the segment driver IC 100 are also shown in FIG. 9. This liquid crystal device is installed in a portable telephone, for example. The liquid crystal device displays a full screen display on the panel 10 in a normal operation mode, and displays only part of the panel 10 in a wait mode. Therefore, the liquid crystal device is driven at a high duty in the normal operation mode, and driven at a low duty in the wait mode.

Figure 10:
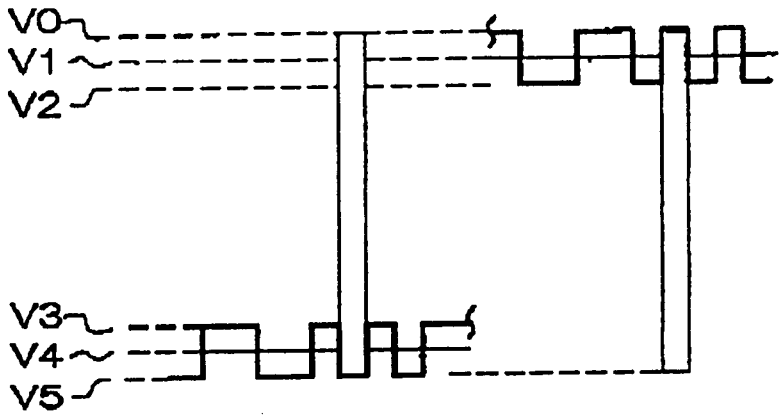
FIG. 10 is a view showing a liquid crystal waveform using an voltage averaging method.
Figure 11:
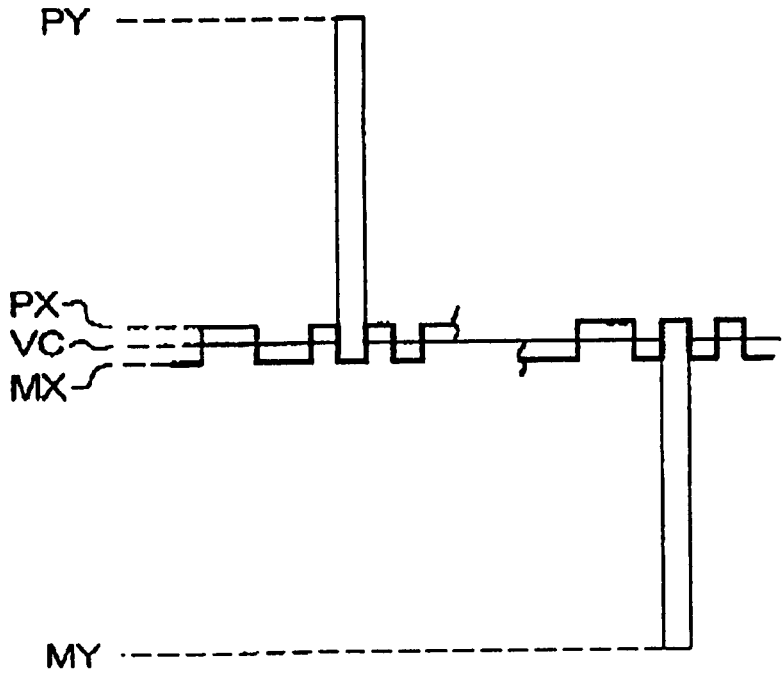
FIG. 11 is a view showing a liquid crystal waveform using a principle drive method.

In the simple matrix panel 10, pixels are formed at each intersection point of the common electrodes 12 and the segment electrodes 14. As a drive waveform supplied to the common electrodes 12 and the segment electrodes 14 of the panel 10, two types of drive waveforms are conventionally known. One of them is a drive waveform using a voltage averaging method shown in FIG. 10. The other is a drive waveform using a principle drive method (also called APT method) shown in FIG. 11. In FIGS. 10 and 11, bold lines indicate drive waveforms of the segment electrodes and thin lines indicate drive waveforms of the common electrodes. The differential voltage between the voltages applied to each electrode is applied to the pixels using either the drive waveform shown in FIG. 10 or the drive waveform shown in FIG. 11. The same voltage is applied to the liquid crystals to be driven using both methods while only the absolute potential applied to each electrode varies.

First Embodiment

The root-mean-square voltage of the voltage applied to one pixel of the simple matrix panel 10 is represented by the following equation developed by Ruckmongathan.

n: Drive duty

L: Simultaneous selection number c: Bias ratio

V: Selection voltage $$\mathrm{RMS} = \frac{\sqrt{LV^2}}{\sqrt{n}}\sqrt{nc^2 \pm 2c + 1}\ \Lambda \tag{1}$$

The sign "±" for 2c in the root is "+", in a pixel turned on and is "−" in a pixel turned off. The principle of this equation is described in detail in Ruckuongathan, T. N., "A GENERALIZED ADDRESSING TECHNIQUE FOR RMS RESPONDING MATRIX LCDS" 1988 INTERNATIONAL DISPLAY RESEARCH CONFERENCE, pp. 80 to 85. Therefore, description thereof is omitted.

Substituting 1 for the simultaneous selection number L in equation (1) yields the following equation.

$$\mathrm{RMS}(L=1) = \frac{V}{\sqrt{n}}\sqrt{nc^2 \pm 2c + 1}\ \Lambda \tag{2}$$

Equation (2) represents the root-mean-square voltage at the time of one-line selection driving using the voltage averaging method (Kawakami method) or principle drive method (APT method).

The display modes in the liquid crystal device used in a portable telephone include a normal operation made in which the full screen (for example, 100 lines) of the panel 10 shown in FIG. 9 is driven, and a wait mode in which an icon or the like is displayed on part (for example, lines 1 to 25) of the panel 10 shown in FIG. 9. In the wait mode, lines 26 to 100 are not driven. Therefore, the liquid crystals are driven at a high duty in the normal operation mode, and driven at a low duty in the wait mode.

Figure 1:
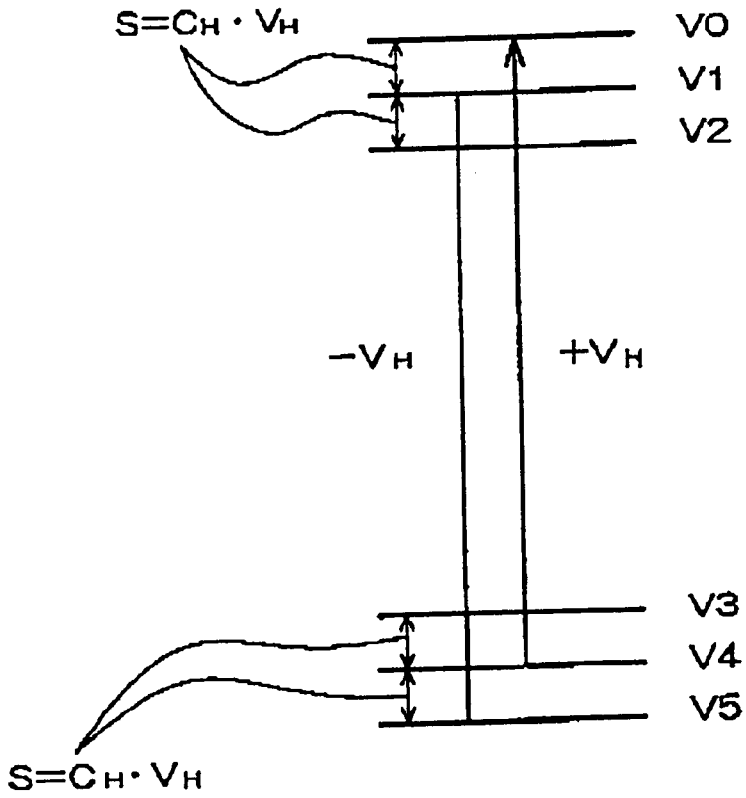
FIG. 1 shows a bias ratio in driving at a high duty using an voltage averaging method.
Figure 2:
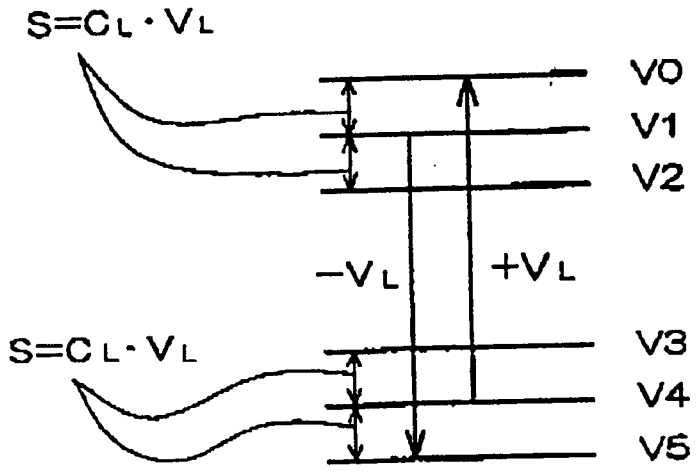
FIG. 2 shows a bias ratio in driving at a low duty using an voltage averaging method.
Figure 3:
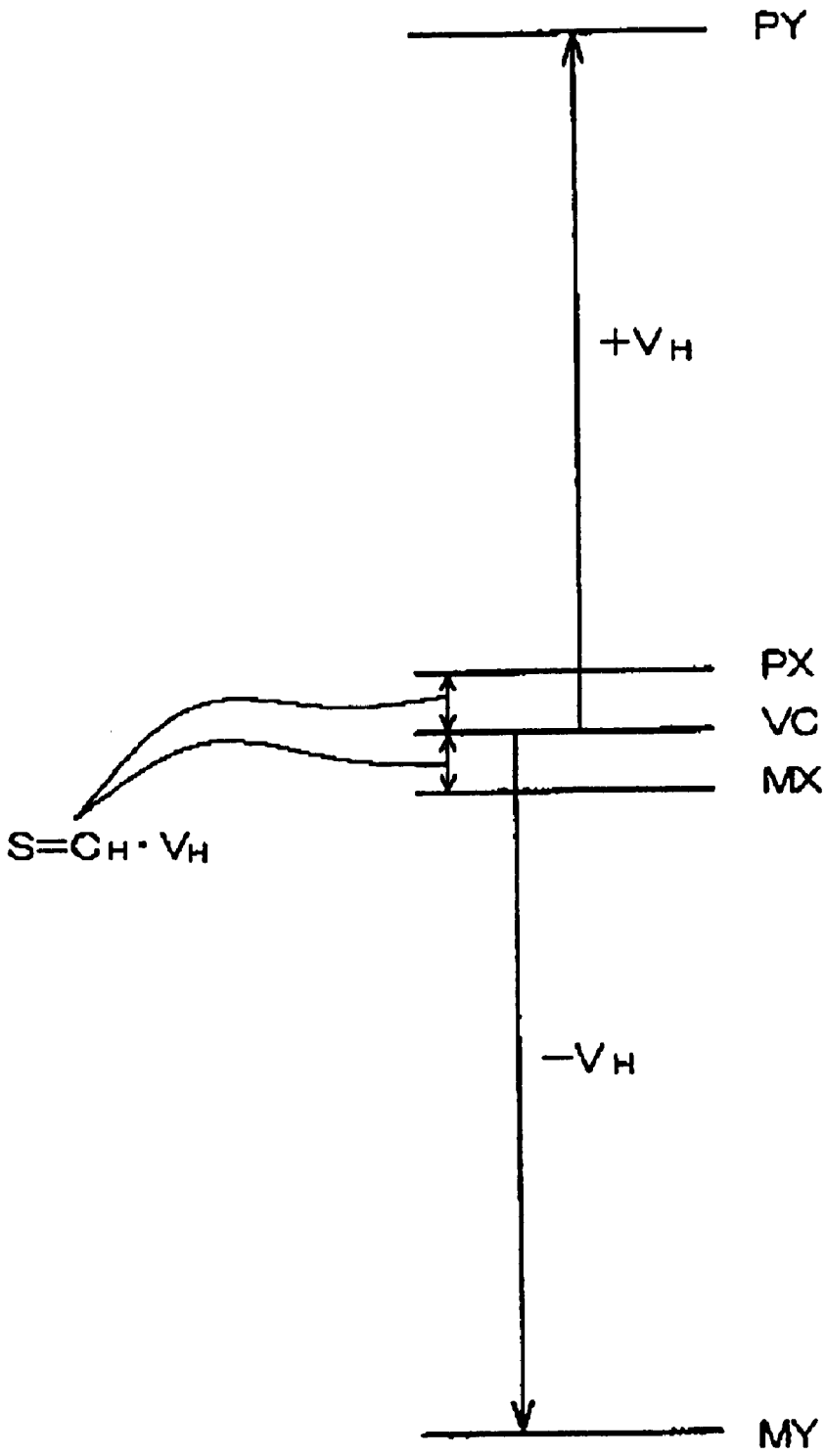
FIG. 3 shows a bias ratio in driving at a high duty using a principle drive method.
Figure 4:
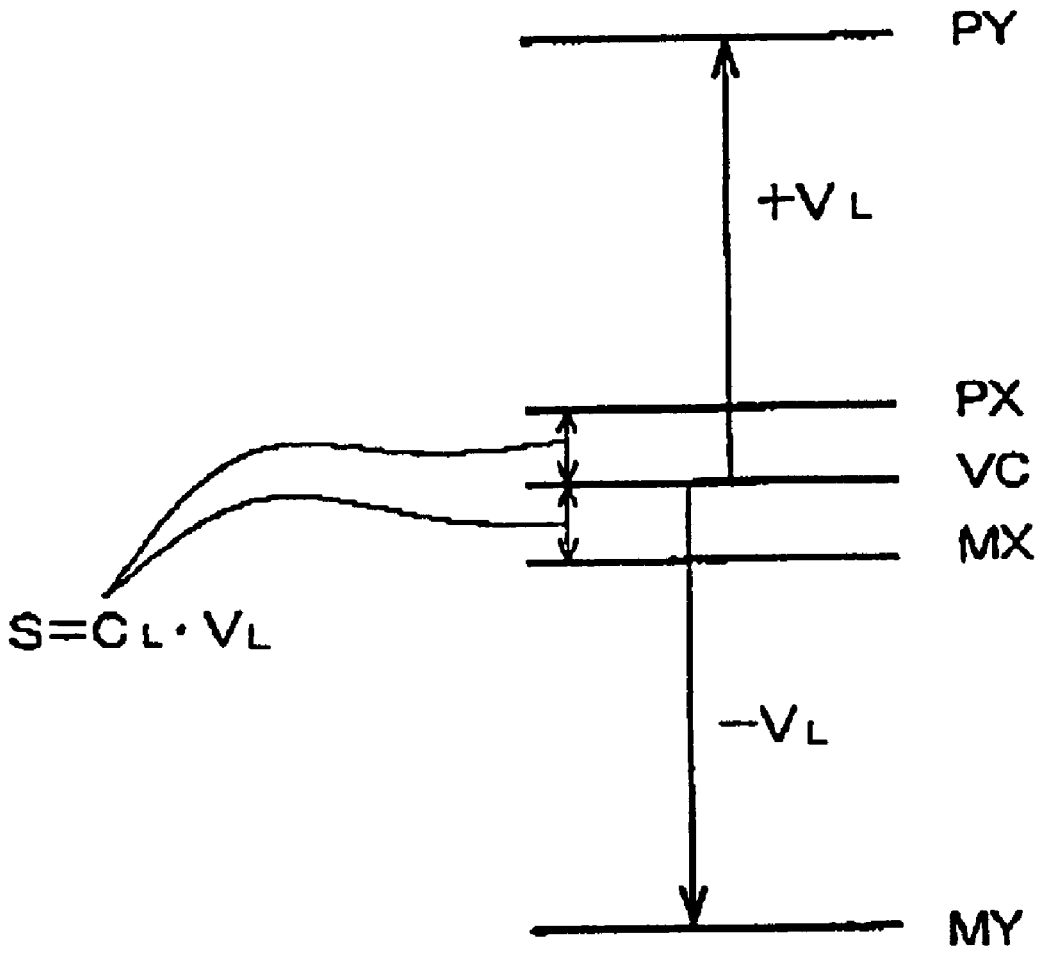
FIG. 4 shows a bias ratio in driving at a low duty using a principle drive method.

FIG. 1 shows a bias ratio of the power supply when the liquid crystal device is driven at a high duty using the voltage averaging method shown in FIG. 10. FIG. 2 shows the bias ratio of the power supply when the liquid crystal device is driven at a low duty in the same manner as in FIG. 1. FIGS. 3 and 4 show the bias ratios of the power supply using the principle drive method (APT method) shown in FIG. 11. FIG. 3 shows the bias ratio of the power supply when the liquid crystal device is driven at a high duty. FIG. 4 shows the bias ratio of the power supply when the liquid crystal device is driven at a low duty.

The bias ratio in equation (1) means a ratio of the half value of a unit signal voltage amplitude dependent on one pixel to the half value of a selection voltage amplitude. The half value S (L=1) of the signal voltage amplitude in one-line selection driving shown in FIGS. 1 to 4 is the unit signal voltage amplitude since L equals 1, which is expressed as follows.

$$S(L=1)=L\cdot c\cdot V=c\cdot V \quad \Lambda(3)$$

In FIGS. 1 and 3, $\pm V_H$ shows a common voltage amplitude in high-duty driving. In FIGS. 2 and 4, $\pm V_L$ shows a common voltage amplitude in low-duty driving. In FIGS. 1 to 4, S shows the half value of the segment voltage amplitude in one-line selection driving.

The bias ratio c in equation (2) means the ratio represented by (half value of segment voltage amplitude)/(half value of common voltage amplitude) at the time of one-line selection driving. The bias ratio $c_H$ equals $S/V_H$ in the high-duty driving shown in FIGS. 1 and 3. The bias ratio $c_L$ equals $S/V_L$ in the low-duty driving shown in FIGS. 2 and 4.

Equation (1) is also applied to multi-line selection driving, which will be described later.

Substituting duty $n_H$, bias ratio $c_H$, and selection voltage $V_H$ in the high-duty driving shown in FIGS. 1 and 3 in equation (2) yields the following equation.

$$\mathrm{RMS}(L=1, n_H) = \frac{V_H}{\sqrt{n_H}}\sqrt{n_H\cdot(c_H)^2 \pm 2c_H + 1}\ \Lambda \tag{4}$$

Substituting duty $n_L$, bias ratio $c_L$, and selection voltage $V_L$ in the low-duty driving shown in FIGS. 2 and 4 in equation (2) yields the following equation.

$$\mathrm{RMS}(L=1, n_L) = \frac{V_L}{\sqrt{n_L}}\sqrt{n_L\cdot(c_L)^2 \pm 2c_L + 1}\ \Lambda \tag{5}$$

Equation (3) is expressed as follows using the signs in the high-duty driving and low-duty driving.

$$S(L=1,n_H)=c_H\cdot V_H \quad \Lambda(6)$$

$$S(L=1,n_1)=c_L\cdot V_L \quad \Lambda(7)$$

The intermediate voltages of the ON voltage and the OFF voltage will be considered. Removing $\pm 2c_H$ and $\pm 2c_L$ from equations (4) and (5) respectively yields the following equations.

$$\mathrm{RMS}_{MID}(L=1, n_H) = \frac{V_H}{\sqrt{n_H}}\sqrt{n_H\cdot(c_H)^2 + 1}\ \Lambda \tag{8}$$

$$\mathrm{RMS}_{MID}(L=1, n_L) = \frac{V_L}{\sqrt{n_L}}\sqrt{n_L\cdot(c_L)^2 + 1}\ \Lambda \tag{9}$$

The intermediate voltages $\mathrm{RMS}_{MID}$ of the root-mean-square voltages between the ON voltage and the OFF voltage must be equal in both the high-duty driving and low-duty driving. Therefore, equation (8) equals equation (9). Substituting the relations in equations (6) and (7) therein yields the following equation.

$$\frac{S}{c_H\sqrt{n_H}}\sqrt{n_H\cdot(c_H)^2+1}=\frac{S}{c_L\sqrt{n_L}}\sqrt{n_L\cdot(c_L)^2+1}\ \Lambda \tag{10}$$

Raising both sides of equation (10) to the second power and simplifying the equation yield the following equation.

$$c_L^2\cdot n_L=c_H^2\cdot n_H \quad \Lambda(11)$$

Equation (11) indicates the following. Specifically, the intermediate values between the ON voltage and the OFF voltage applied to the pixels do not change by maintaining the relation between the display duties and the bias ratios so that the products of the display duties ($n_L$, $n_H$) and the bias ratios ($c_L$, $c_H$) raised to the second power do not change ($n\cdot c^2$=constant).

For example, in the case of driving 100 lines ($n_H$=100) at a bias ratio $c_H$ of 1/10 and then driving only 10 lines ($n_L$=10) by an external signal at a bias ratio $c_L$ of 0.316 . . . (1/square root of 10), the half-tone display becomes constant when displaying a partial display by changing the display duty. Therefore, the user does not have to adjust the contrast.

Second Embodiment

Figure 5:
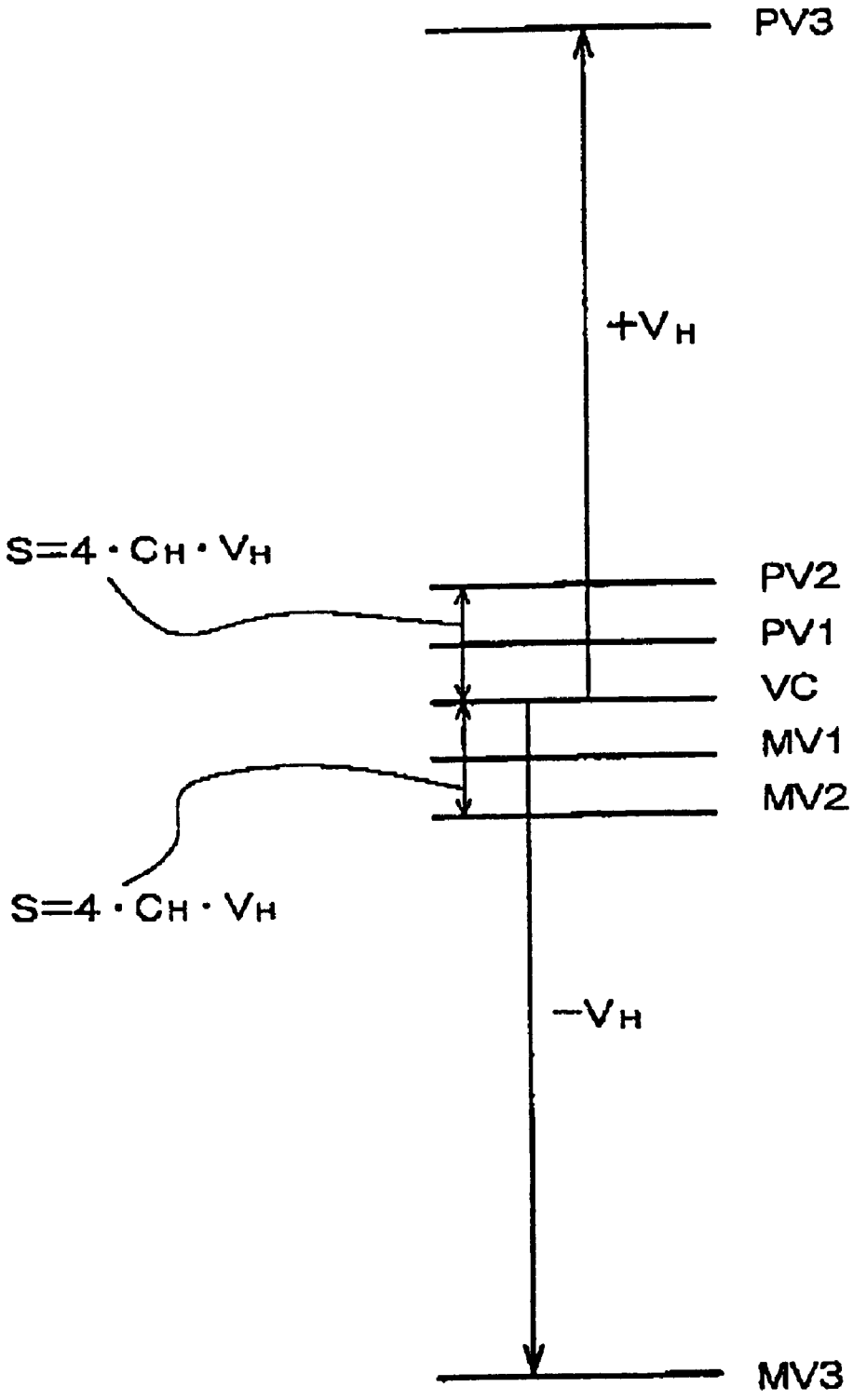
FIG. 5 shows a bias ratio in driving at a high duty using a four-line selection method.
Figure 6:
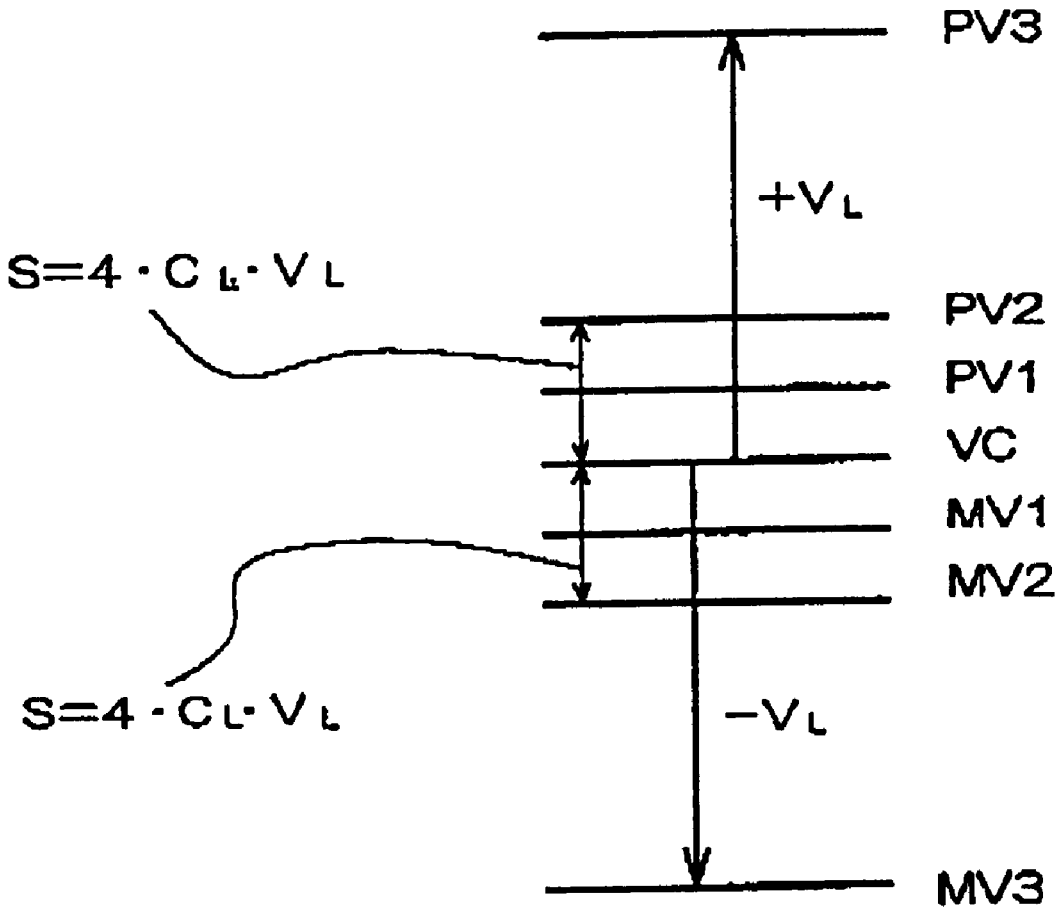
FIG. 6 shows a bias ratio in driving at a low duty using a four-line selection method.

FIG. 5 shows a bias ratio of the power supply at a high duty in multi-line selection driving with the simultaneous selection number L in equation (1) being 4. FIG. 6 shows a bias ratio of the power supply at a low duty for displaying partial display in the same multi-line selection driving as in FIG. 5.

Substituting 4 for the simultaneous selection number L in equation (1) yields the following equation. The simultaneous selection number L may be a number other than 4, which is an example.

$$\mathrm{RMS}(L=4)=\frac{2\cdot V}{\sqrt{n}}\sqrt{nc^2\pm 2c+1}\ \Lambda \tag{12}$$

Equation (12) represents the root-mean-square voltage in a 4-line simultaneous selection drive method. In the 4-line simultaneous selection drive method, five levels of signal voltages (PV2, PV1, VC, MV1, MV2) shown in FIG. 5 are required. The signal voltage amplitude S (L=4) represents voltages between PV2 and VC and between VC and MV2 shown in FIG. 5. Since the bias ratio c means the ratio of the half value of the unit signal voltage amplitude dependent on one pixel to the selection voltage amplitude, the signal voltage amplitude S (L=4) is represented by the following equation.

$$S(\mathrm{L}=4)=\mathrm{L}\cdot c\cdot V=4\cdot c\cdot V \quad \Lambda(13)$$

As in the case obtained equations (4) to (7), substituting high duty $n_H$, low duty $n_L$, and the like in equations (12) and (13) respectively yields the following equations (14) to (17).

$$\mathrm{RMS}(L=4,n_H)=\frac{2\cdot V_H}{\sqrt{n_H}}\sqrt{n_H\cdot(c_H)^2\pm 2c_H+1}\ \Lambda \tag{14}$$

$$\mathrm{RMS}(L=4,n_L)=\frac{2\cdot V_L}{\sqrt{n_L}}\sqrt{n_L\cdot(c_L)^2\pm 2c_L+1}\ \Lambda \tag{15}$$

$$S(\mathrm{L}=4,\mathrm{n}_H)=4\cdot c_H\cdot V_H \quad \Lambda(16)$$

$$S(\mathrm{L}=4,\mathrm{n}_L)=4\cdot c_L\cdot V_L \quad \Lambda(17)$$

The intermediate voltages between the ON voltage and the OFF voltage will be considered in the same manner as in the first embodiment. Removing $\pm 2c_H$ and $\pm 2c_L$ from equations (14) and (15) respectively yields the following equations.

$$\mathrm{RMS}_{MID}(L=4,n_H)=\frac{2\cdot V_H}{\sqrt{n_H}}\sqrt{n_H\cdot(c_H)^2+1}\ \Lambda \tag{18}$$

$$\mathrm{RMS}_{MID}(L=4,n_L)=\frac{2\cdot V_L}{\sqrt{n_L}}\sqrt{n_L\cdot(c_L)^2+1}\ \Lambda \tag{19}$$

As described above, the intermediate voltages $\mathrm{RMS}_{MID}$ of the root-mean-square voltages are equal if equation (18) equals equation (19). Substituting equations (16) and (17) therein yields the following equation.

$$\frac{S}{c_H\sqrt{n_H}}\sqrt{n_H\cdot(c_H)^2+1}=\frac{S}{c_L\sqrt{n_L}}\sqrt{n_L\cdot(c_L)^2+1}\ \Lambda \tag{20}$$

Raising both sides of equation (20) to the second power and simplifying the equation yields the following equation.

$$c_L^2\cdot n_L=c_H^2\cdot n_H \quad \Lambda(21)$$

Therefore, the intermediate values $\mathrm{RMS}_{MID}$ between the ON voltage and the OFF voltage applied to the pixels do not change by maintaining the relation $n\cdot c^2$ =constant in the multi-line selection driving in the second embodiment in the same manner as in the one-line selection driving in the first embodiment.

For example, when driving 100 lines ($n_H$=100) at a bias ratio $c_H$ of 1/10 with the simultaneous selection number L being 10, and then driving only 10 lines ($n_L$=10) by an external signal at a bias ratio $c_L$ of 0.316 . . . (1/square root of 10), the user does not have to adjust the contrast when changing the display duty to display a partial display.

Third Embodiment

Examples 1 and 2 take into consideration only the intermediate values between the ON voltage and the OFF voltage. The ratio of the ON voltage to the OFF voltage (hereinafter called "operation margin") also varies. The third embodiment illustrates a method of setting conditions while taking into consideration the ON voltage and the OFF voltage.

Modifying-equation (1) while taking into consideration S=L·c·V yields the following equation.

$$\mathrm{RMS}=\frac{S}{c\cdot\sqrt{n}\cdot\sqrt{L}}\sqrt{nc^2\pm 2c+1}\ \Lambda \tag{22}$$

Figure 7:
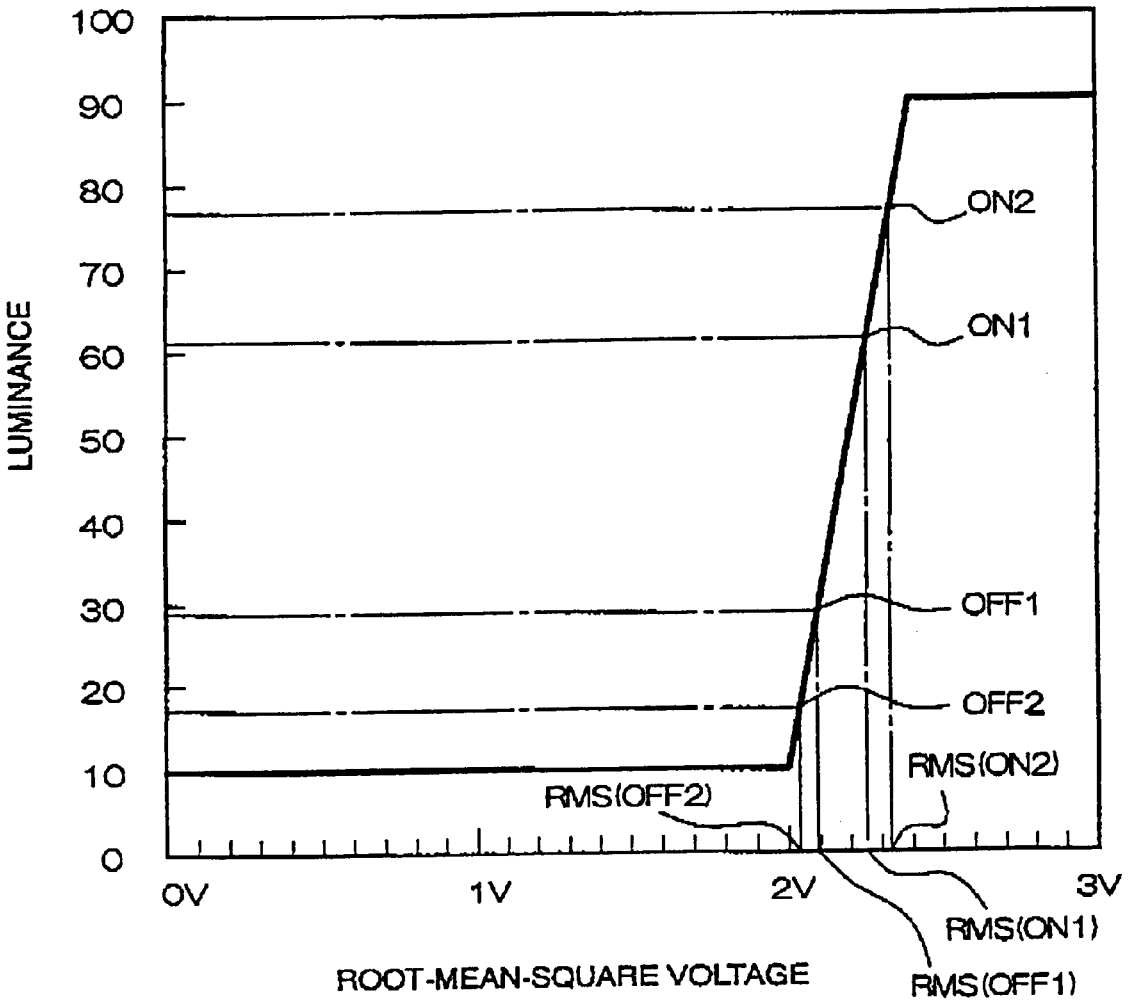
FIG. 7 shows the relation between a voltage and luminance of a liquid crystal panel at each operation point in high-duty driving and low-duty driving in a third embodiment of the present invention.

As shown in FIG. 7, suppose that the root-mean-square voltage when applying the ON voltage to the liquid crystals at a bias ratio of $c_1$ and a display duty of $n_1$ is RMS (ON1), and the root-mean-square voltage when applying the OFF voltage to the liquid crystals is RMS (OFF1). Suppose that the root-mean-square voltage when applying the ON voltage to the liquid crystals at a bias ratio of $c_2$ and a display duty of $n_2$ is RMS (ON2), and the root-mean-square voltage when applying the OFF voltage to the liquid crystals is RMS (OFF2).

FIG. 7 is a characteristic view showing the relation between the voltage and luminance of a liquid crystal panel. The luminance is indicated in practice by a unit such as nit or candela. The unit is omitted in FIG. 7, in which the luminance is indicated by dimensionless numbers. FIG. 7 shows an example in which the luminance increases as the voltage increases. The present invention may be applied to liquid crystal panels in which the luminance decreases as the voltage increases.

In the liquid crystal panel having the characteristics shown in FIG. 7, liquid crystals react when the root-mean-square voltage becomes more than 2.0 V, thereby increasing the luminance. The luminance is saturated when the root-mean-square voltage becomes 2.4 V.

A contrast of 60 to 30 (contrast ratio=2) is obtained in the driving at a bias ratio of $c_1$ and a display duty of $n_1$. Therefore, a contrast ratio of 2 or more is obtained after changing to a partial display of a bias ratio of $c_2$ and a display duty of $n_2$ by maintaining two relations RMS (ON1)≦RMS (ON2) and RMS (OFF1)≧RMS (OFF2).

This will be described in more detail using equations.

The root-mean-square voltages RMS (ON1), RMS (ON2), RMS (OFF1), and RMS (OFF2) shown in FIG. 7 are expressed as follows.

$$\mathrm{RMS}(ON1) = \frac{S}{c_1 \cdot \sqrt{n_1} \cdot \sqrt{L}} \sqrt{n_1 c_1^2 + 2c_1 + 1}\ \Lambda \tag{23}$$

$$\mathrm{RMS}(OFF1) = \frac{S}{c_1 \cdot \sqrt{n_1} \cdot \sqrt{L}} \sqrt{n_1 c_1^2 - 2c_1 + 1}\ \Lambda \tag{24}$$

$$\mathrm{RMS}(ON2) = \frac{S}{c_2 \cdot \sqrt{n_2} \cdot \sqrt{L}} \sqrt{n_2 c_2^2 + 2c_2 + 1}\ \Lambda \tag{25}$$

$$\mathrm{RMS}(OFF2) = \frac{S}{c_2 \cdot \sqrt{n_2} \cdot \sqrt{L}} \sqrt{n_2 c_2^2 - 2c_2 + 1}\ \Lambda \tag{26}$$

If the root-mean-square voltages of the ON voltages are equal, equation (23) equals equation (25), thereby yielding the following equation.

$$\frac{1}{c_1 \cdot \sqrt{n_1}} \sqrt{n_1 c_1^2 + 2c_1 + 1} = \frac{1}{c_2 \cdot \sqrt{n_2}} \sqrt{n_2 c_2^2 + 2c_2 + 1}\ \Lambda \tag{27}$$

If the root-mean-square voltages of the OFF voltages are equal, equation (24) equals equation (26), thereby yielding the following equation.

$$\frac{1}{c_1 \cdot \sqrt{n_1}} \sqrt{n_1 c_1^2 - 2c_1 + 1} = \frac{1}{c_2 \cdot \sqrt{n_2}} \sqrt{n_2 c_2^2 - 2c_2 + 1}\ \Lambda \tag{28}$$

Since the simultaneous selection number L is removed in equations (27) and (28), these equations apply to both one-line selection driving and L-line (L≧2) simultaneous selection driving.

Simplifying equation (27) yields the following equation which indicates the condition in which the ON voltages are equal.

$$\frac{n_2}{n_1} = \frac{c_1^2 \cdot (+2c_2 + 1)}{c_2^2 \cdot (+2c_2 + 1)}\ \Lambda \tag{29}$$

For example, when changing the bias ratios $c_1$ and $c_2$ to ⅛ and ¼, respectively, the relation between the duties $n_1$ and $n_2$ in equation (29) is expressed as follows.

$$\frac{n_2}{n_1} = \frac{\left(\frac{1}{8}\right)^2 \cdot \left(2\frac{1}{4} + 1\right)}{\left(\frac{1}{4}\right)^2 \cdot \left(2\frac{1}{8} + 1\right)} = 0.3\ \Lambda \tag{30}$$

Specifically, the duty ratio may be set at 30% when the bias ratio is determined as described above. For example, if $n_1$ equals 100, $n_2$ equals 30.

Simplifying equation (28) yields the following equation which indicates the condition in which the ON voltages are equal.

$$\frac{n_2}{n_1} = \frac{c_1^2 \cdot (-2c_2 + 1)}{c_2^2 \cdot (-2c_1 + 1)}\ \Lambda \tag{31}$$

For example, substituting ⅛ and ¼ for $c_1$ and $c_2$ respectively yields the following equation.

$$\frac{n_2}{n_1} = \frac{\left(\frac{1}{8}\right)^2 \cdot \left(-2\frac{1}{4} + 1\right)}{\left(\frac{1}{4}\right)^2 \cdot \left(-2\frac{1}{8} + 1\right)} = \frac{\left(\frac{1}{8}\right)^2 \cdot \left(\frac{2}{4}\right)}{\left(\frac{1}{4}\right)^2 \cdot \left(\frac{3}{4}\right)} = \frac{1}{6} = 0.166\ \Lambda \tag{32}$$

Specifically, the duty ratio may be set at 17% when the bias ratio is determined as described above. When changing from driving at a display duty $n_1$ of 100 and a bias ratio of ⅛ to driving at a bias ratio $c_2$ of ¼, a contrast higher than that before changing can be secured without adjusting the contrast by setting the display duty $n_2$ between 30 and 17.

When the duty ratio is previously determined, the bias ratio is set as follows. For example, a case of changing the duty ratio from $n_1$=100 to $n_2$=50 is described below. Suppose that the bias ratio $c_1$ is 1/10 when the duty $n_1$ is 100. The condition in which the ON voltages are equal is represented by the following quadratic equation.

$$\frac{50}{100} = \frac{\left(\frac{1}{10}\right)^2 \cdot (+2c_2 + 1)}{c_2^2 \cdot \left(+2\frac{1}{10} + 1\right)}\ \Lambda \tag{33}$$

When equation (33) is solved, $c_2$ equals 0.146837.

The condition in which the OFF voltages are equal is represented by the following quadratic equation.

$$\frac{50}{100} = \frac{\left(\frac{1}{10}\right)^2 \cdot (-2c_2 + 1)}{c_2^2 \cdot \left(-2\frac{1}{10} + 1\right)}\ \Lambda \tag{34}$$

When equation (34) is solved, $c_2$ equals 0.135078.

As described above, when changing the driving at a display duty $n_l$ of 100 and a bias ratio of 1/10 to driving at a duty ratio $n_2$ of 50, a contrast higher than that before changing can be secured without adjusting the contrast by setting the bias ratio $c_2$ between 0.146837 and 0.135078.

Fourth Embodiment

The third embodiment illustrates the case of changing the display driving between two display duties. The case of setting the bias ratio conditions when employing two display duties among three or more duties will be described here. In this case, the user does not have to adjust the contrast by setting the bias ratio in the same manner as in the third embodiment.

Figure 8:
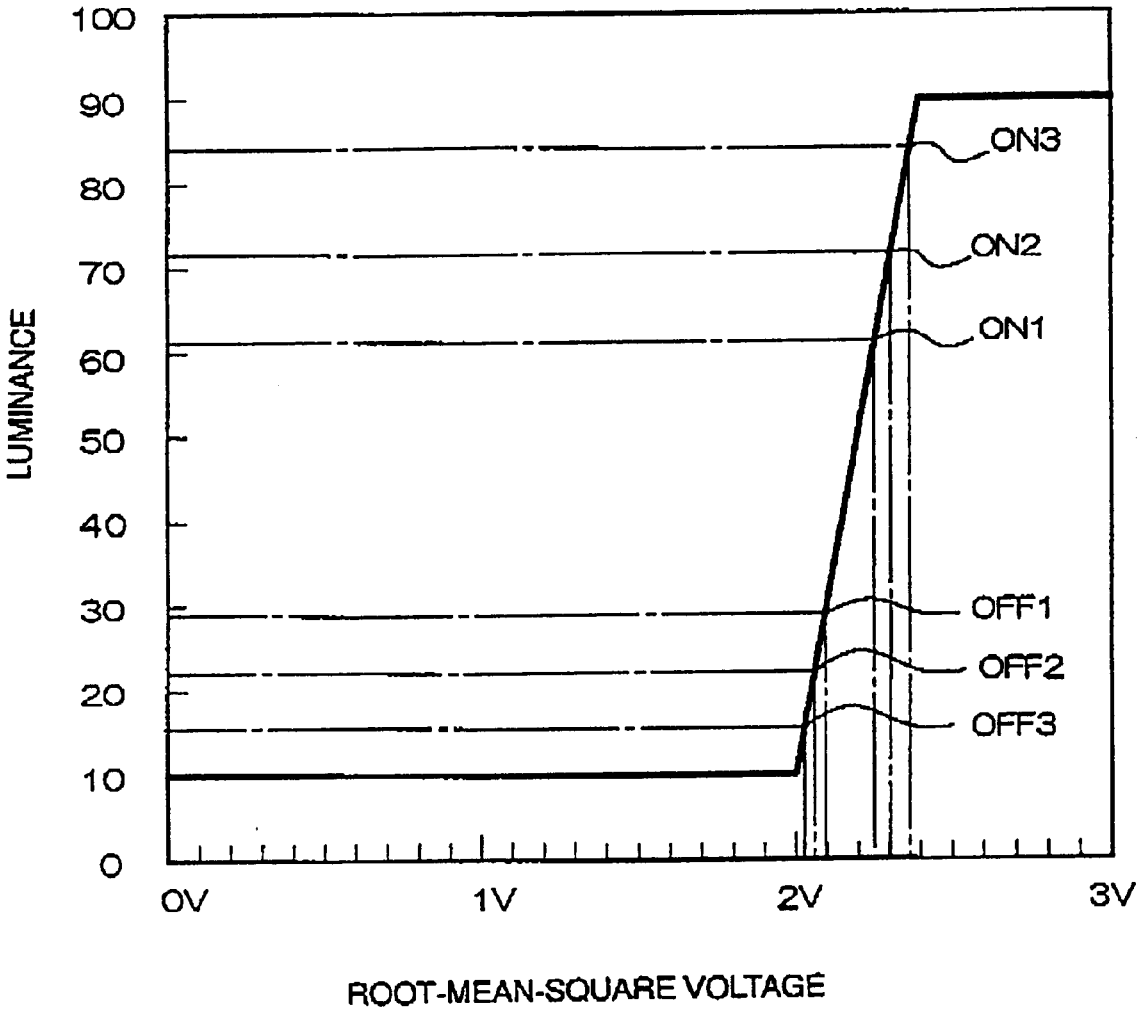
FIG. 8 shows the relation between a voltage and luminance of a liquid crystal panel at operation points in a fourth embodiment using three duties.

FIG. 8 shows a root-mean-square voltage RMS (ON3) of the ON voltage and a root-mean-square voltage RMS (OFF3) of the OFF voltage at a bias ratio of $c_3$ and a display duty of $n_3$, in addition to the root-mean-square voltages RMS (ON1), RMS (OFF1), RMS (ON2), and RMS (OFF2) shown in FIG. 7.

The conditions required in the third embodiment are RMS (ON1)≦RMS (ON2) and RMS (OFF1)≧RMS (OFF2).

In the same manner as in the third embodiment, the conditions required between the display at a bias ratio of $c_1$ and a display duty of $n_1$ and the display at a bias ratio of $c_1$ and a display duty of $n_1$ are RMS (ON1)≦RMS (ON3) and RMS (OFF1)≧RMS (OFF3).

The conditions required between the display at a bias ratio of $c_2$ and a display duty of $n_2$ and the display at a bias ratio of $c_3$ and a display duty of $n_3$ are EMS (ON2)≦RMS (ON3) and RMS (OFF2)≧RMS (OFF3).

The user does not have to adjust the contrast by setting the relation between two duties among three or more duties in the above manner.

EXAMPLE 5

Example 5 illustrates a method of driving the liquid crystal device by changing the duty with reference to details of the segment driver IC 100 and the common driver IC 200 shown in FIG. 9.

Figure 12:
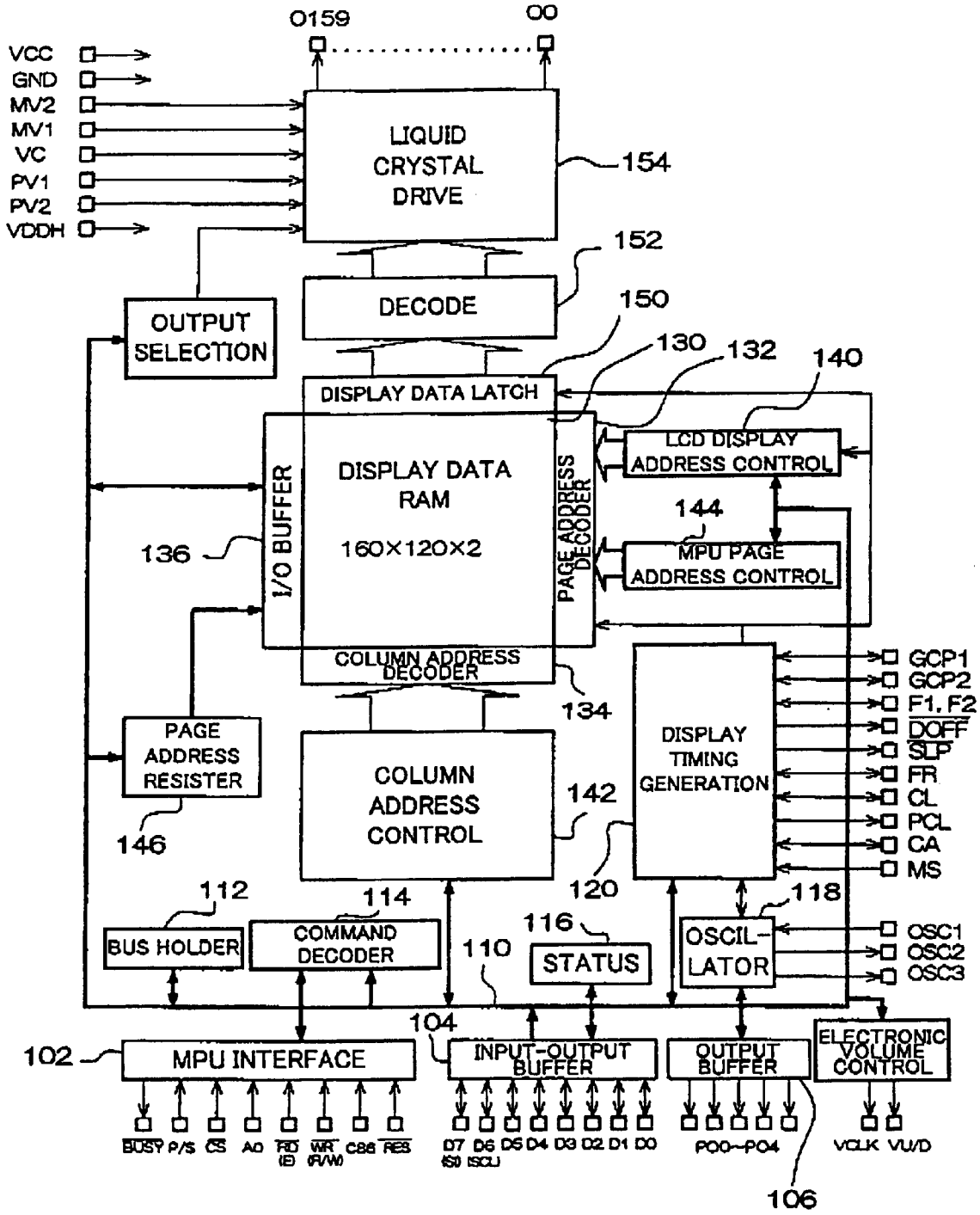
FIG. 12 is a circuit diagram of the segment driver IC shown in FIG. 9.

FIG. 12 shows the segment driver IC 100. In FIG. 12, an MPU interface 102, an input-output buffer 104, and an output buffer 106 are provided as input-output circuits of the IC 100. A bus holder 112, a command decoder 114, a status circuit 116, an oscillator circuit 118, and a timing generation circuit 120 are connected to an internal bus 110 which is connected to the input-output circuits 102, 104, and 106.

The contents of commands designating either the normal operation mode or the wait mode from the MPU 300 are input to the input-output buffer 104 as 8-bit data after the signal to an A0 terminal of the MPU interface 102 has become LOW, and are decoded by a command decoder 114. The display duty is set by the counting of a reference clock from the oscillator circuit 118 by the display timing generation circuit 120.

Therefore, the display timing generation circuit 120 sets a high duty in the normal operation mode and sets a low duty in the wait mode according to the commands input through the internal bus 110. Display data from a display data RAM 130 are read out according to the duty set by the display timing generation circuit 120. In addition, the liquid crystal device may be driven with low power consumption in the low duty driving, in particular, by lowering the frequency of the reference clock from the oscillator circuit 118.

A page address decoder 132 and a column address decoder 134 are provided for the display data RAM 130 to read out the display data, and the read-out address of the display data RAM 130 is designated. An LCD display address control circuit 140 is connected to the page address decoder 132. A column address control circuit 142 is connected to the column decoder 134. An MPU page address control circuit 144 connected to the page address decoder 132 is used to read and write the contents of the display data RAM 130 on the basis of the commands from the MPU 300 shown in FIG. 9.

Data is read out from the display data RAM 130 or written therein through an I/O buffer 136 on the basis of the commands from the MPU 300. The page address at the time of reading and writing is designated by the page address register 146.

The display data read out from the display data RAM 130 is latched by a display data latch circuit 150, decoded by a decode circuit 152, and supplied to the segment electrodes 14 shown in FIG. 9 through a liquid crystal drive circuit 154. The segment driver IC 100 carries out the multi-line selection drive method with the simultaneous selection number L of 4. Therefore, 5 level potentials including PV1, PV2, VC, HV1, and MV2 shown in FIG. 5 are supplied to the segment electrodes 14 in the normal operation mode. The supply potentials in the wait mode will be described later.

Next, the common driver 200 shown in FIG. 9 will be described with reference to FIG. 13.

Figure 13:
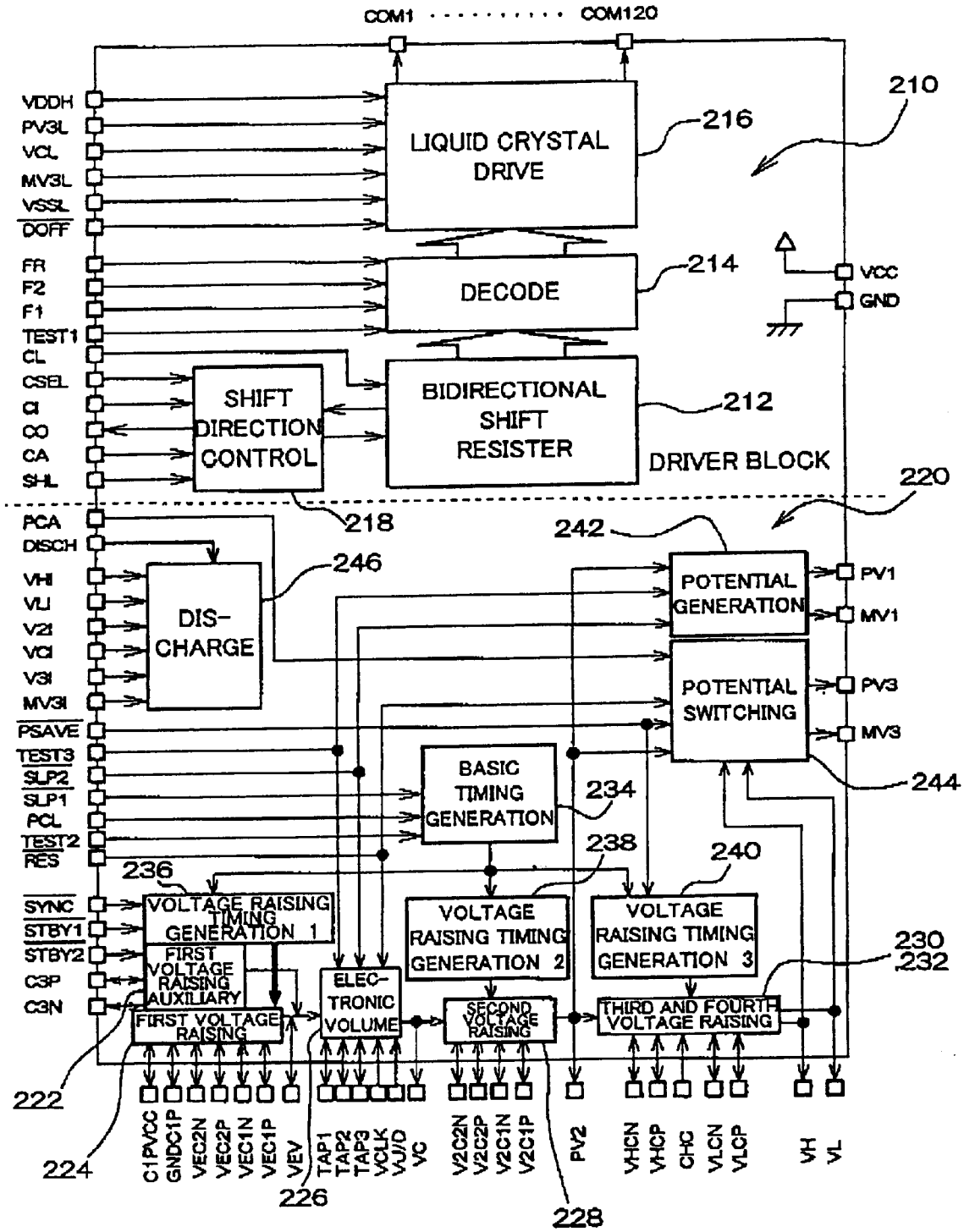
FIG. 13 is a circuit diagram of the common driver IC shown in FIG. 9.

The common driver IC 200 shown in FIG. 13 has a common drive circuit 210 and a power supply circuit 220. The common drive circuit 210 has a bidirectional shift register 212, a decode circuit 214 which decodes the output therefrom, and a liquid crystal drive circuit 216 which supplies a voltage to the common electrodes 12 shown in FIG. 9 in accordance with the decoding results. The bidirectional shift register 212 enables scanning from both the top and the bottom of the screen. The scanning direction is controlled by the output from a shift direction control circuit 218 which inputs commands from the MPU 300 on the scanning direction through the segment driver IC 100.

The power supply circuit 220 generates 7 levels of potentials (PV3, PV2, PV1, VC, MV1, MV2, MV3) shown in FIG. 5. A first voltage raising auxiliary circuit 222, a first voltage raising circuit 224, an electronic volume 226, a second voltage raising circuit 228, and third and fourth voltage raising circuits 230 and 232 are provided therefor in the power supply circuit 220 shown in FIG. 13. The first to fourth voltage raising circuits are formed of charging pumps. A basic timing generation circuit 234 and first to third voltage raising timing generation circuits 236, 238, and 240 are provided in the power supply circuit 220 to generate voltage raising timing in each voltage raising circuit. A potential generation circuit 242, a potential switching circuit 244, and a discharge circuit 246 are also provided in the power supply circuit 220. The potential generation circuit 242 generates the potentials PV1 and MV1 by lowering the potentials PV2 and MV2 from the second voltage raising circuit 228. The potential switching circuit 244 switches potentials output from terminals PV3 and MV3. The potential switching circuit 244 outputs the potentials MV3 and PV3 from the third and fourth voltage raising circuits 230 and 232 in the normal operation mode, and outputs the potentials PV2 and MV2 according to the output from the second voltage raising circuit 228 in the wait mode. The wait mode is designated by the commands from the MPU 300. Specifically, the commands designating the wait mode are output from the output buffer 106 of the segment driver IC 100 shown in FIG. 12. This causes the logic of a power saving terminal (/PSAVE) of the common driver IC 200 to be HIGH, for example, thereby entering the wait mode. The signals from the power saving terminal are also input to the third voltage raising timing generation circuit 240. The operations of the third and fourth voltage raising circuits 230 and 232 are stopped in the wait mode according to the signals from the third voltage raising timing generation circuit 240.

The operation of the power supply circuit 220 shown in FIG. 13 will be described with reference to FIG. 14. Power supply potentials VDD and VSS are raised by the first voltage raising circuit 224. The raised potentials are adjusted to an appropriate potential VC by the electronic volume 226. Since other potentials PV3, PV2, PV1, MV1, MV2, and MV3 are generated on the basis of the potential VC, contrast-and luminance can be adjusted by adjusting the potential VC by the electronic volume 226. In addition, if the contrast has already been adjusted, it is unnecessary to adjust the contrast by operating the electronic volume 226 each time the liquid crystal device is driven while changing the duty.

The second voltage raising circuit 228 generates the potential PV2 by raising the voltage between the potential VC and the power supply potential VSS. The power supply potential VSS is used as the potential MV2.

The potential generation circuit 242 generates the potential MV1 by lowering the voltage between the potentials VC and MV2. The potential generation circuit 242 also generates the potential PV1 by lowering the voltage between the potentials PV2 and VC. In this example, the potential generation circuit 242 is formed of a ½ voltage lowering circuit.

The third voltage raising circuit 230 generates the potential MV3 by raising the voltage between the potentials PV2 and MV2. The fourth voltage raising circuit 232 generates the potential PV3 by raising the voltage between the potentials MV3 and VC.

As described above, seven levels of potentials (PV3, PV2, PV1, VC, MV1, MV2, MV3) shown in FIG. 5 which are required for the 4-line simultaneous selection driving in the normal operation mode can be generated.

Figure 14:
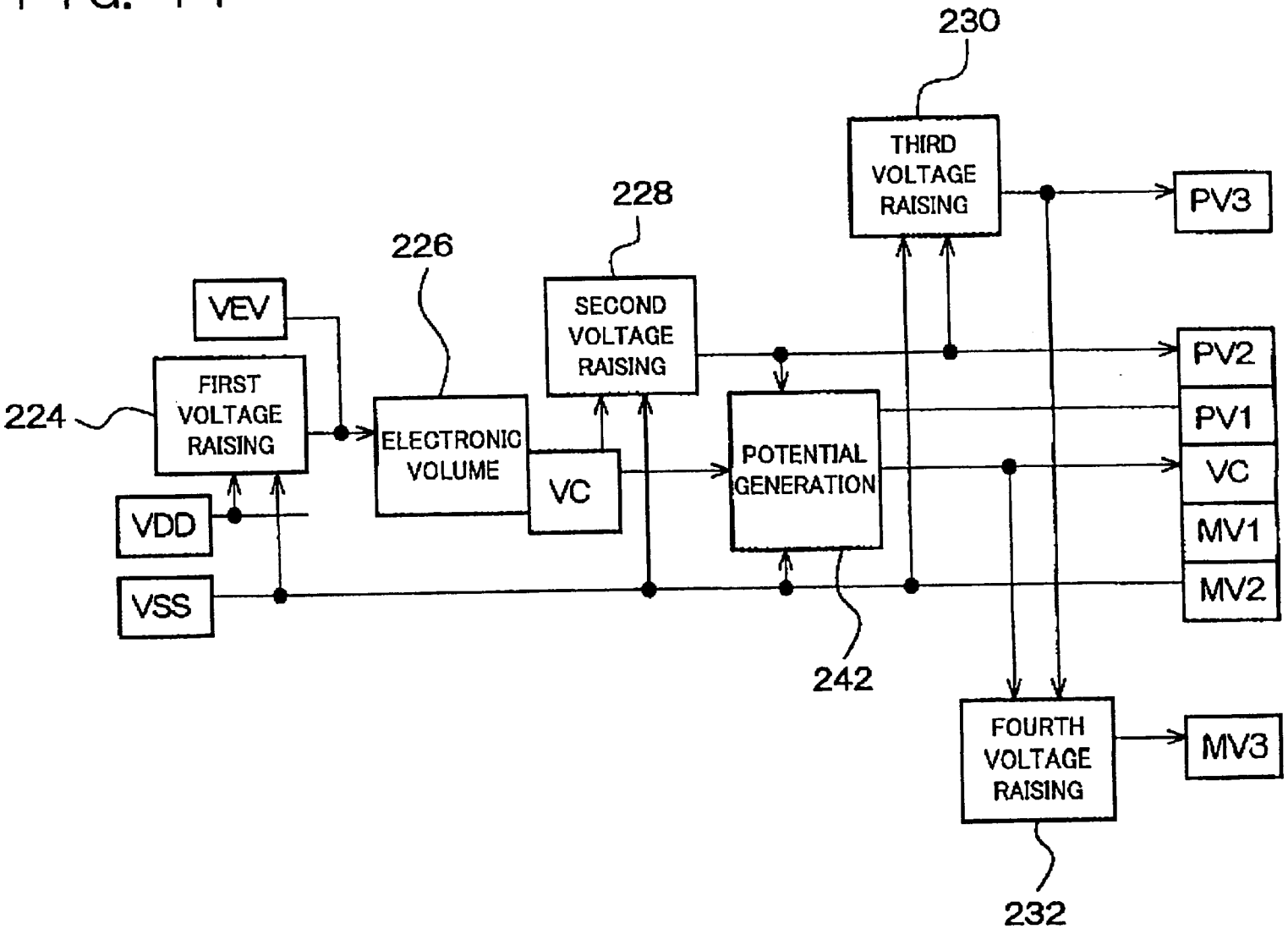
FIG. 14 is a view showing the power supply circuit in the common driver IC shown in FIG. 13.

The contrast in the normal operation mode may be adjusted once by operating the electronic volume 226 shown in FIGS. 13 and 14, as described above. The contrast can be easily adjusted at a constant bias ratio (specifically, the first to fourth voltage-raising multiplying factors are fixed). Conventionally, desired potential levels are generated by a resistance dividing circuit by changing PV3. This causes a problem in which power consumption is increased because direct current flows through the resistance dividing circuit. Moreover, the bias ratio varies. These conventional problems can be solved by this example.

The potential VC has been set equal to the power supply potential VDD. Therefore, when about 3 V is required as the potential VC, the power supply potential VDD must be increased contrary to the demand for decrease in the voltage. In this example, since the potential VC is generated by raising the potential VDD, the power supply potential VDD can be lowered.

Next, driving in the wait mode will be described. As examples of the drive methods in the wait mode, a method of changing the potentials PV3 and MV3 so that the bias ratio is that shown in FIG. 6 instead of the bias ratio in the normal operation mode shown in FIG. 5 can be given. This can be achieved by changing the voltage-raising multiplying factors in the third voltage raising circuit 230 and the fourth voltage raising circuit 232 shown in FIGS. 13 and 14.

In the power supply circuit 220 in the common driver IC 200 shown in FIG. 13, the bias ratio in the wait mode is changed without changing the voltage-raising multiplying factor.

Specifically, the operations of the third and fourth voltage raising circuits 230 and 232 which generate the common potentials PV3 and MV3 are stopped in the wait mode. In the potential switching circuit 244, the segment potentials PV2 and MV2 are supplied to the common electrodes 12 instead of the common potentials PV3 and MV3. The potential switching circuit 244 shown in FIG. 13 allows the PV3 and MV3 terminals shown in FIG. 13 to output the potentials PV2 and MV2 when set in the wait mode by power saving signals.

Therefore, the liquid crystal device, which is driven by 7-level driving in the normal operation mode, is driven by 5-level driving excluding the potentials PV3 and MV3 in the wait mode.

The following equation is a modification of equation (21).

$$n_2=n_1\cdot(c_1/c_2)^2 \qquad \Lambda(35)$$

In equation (35), the bias ratio $c_1$ equals (PV2−VC)/L/PV3, and the bias ratio $c_2$ equals (PV2−VC)/L/PV2. Therefore, $(c_1/c_2)$ in equation (35) equals the ratio of the common potential PV3 in the normal operation mode to the common potential PV2 in the wait mode PV2/PV3 (MV2/MV3). The ratio (MV2/MV3) equals a third voltage-raising multiplying factor "k" in the third voltage raising circuit 230 as shown in FIG. 14. Therefore, $(c_1/c_2)$ in equation (35) equals 1/k. Consequently, equation (35) is expressed as follows, using the third voltage-raising multiplying factor "k".

$$n_2=n_1\cdot(1/K)^2 \qquad \Lambda(36)$$

If $(c_1/c_2)$ in equation (35), that is, the third voltage-raising multiplying factor "k" in equation (36) is either 2 or 3, the relation between the duty $n_1$ in the normal operation mode and the duty $n_2$ in the wait mode becomes as shown in the following Table 1.

TABLE 1

| Normal operation duty $n_1$ | Wait duty $n_2$ (third voltage-raising multiplying factor = 2) | Wait duty $n_2$ (third voltage-raising multiplying factor = 3) |
|---|---|---|
| 80 | 20 | 9 (8) |
| 100 | 25 (24) | 11 (12) |
| 120 | 30 (32) | 13 (12) |
| 140 | 35 (36) | 16 |
| 160 | 40 | 18 (16) |

The values in parentheses indicate the nearest multiples of four.

Since $n_1$ and $n_2$ in the multi-line selection drive method must be multiples of the simultaneous selection number L, the nearest multiples of four are employed in this example.

AS described above, the display duty $n_2$ in the wait mode is determined uniquely it the third voltage-raising multiplying factor and the normal operation duty $n_1$ are determined. The driving at the display duty $n_2$ eliminates the need for adjustment of the contrast.

What is claimed is:

1. A method of driving a liquid crystal device comprising a first substrate on which a plurality of electrodes are formed, a second substrate on which a plurality of segment electrodes are formed, and a liquid crystal interposed between the first substrate and the second substrate, and applying a voltage which changes into at least an ON voltage, an OFF voltage and an intermediate voltage therebetween in accordance with a pulse amplitude modulation to a pixel formed at each intersection point of the common electrodes and the segment electrodes, the method comprising:

a first driving step of driving the liquid crystal device under a condition of a first duty and a first bias ratio; and a second driving step of driving the liquid crystal device under a condition of a second duty and a second bias ratio, wherein the first and the second duties and the first and the second bias ratios are set so that a root-mean-square voltage applied to the pixel when the intermediate voltage is applied to the pixel in the first driving step equals a root-mean-square voltage applied to the pixel when the intermediate voltage is applied to the pixel in the second driving step, thereby the half-tone display both in the first and second driving step become constant.

2. The method of driving a liquid crystal device according to claim 1, wherein one of the common electrodes is sequentially selected in each of the first driving step and the second driving step.

3. The method of driving a liquid crystal device according to claim 1, wherein two or more of the common electrodes are selected together in each of the first driving step and the second driving step.

4. The method of driving a liquid crystal device according to claim 1, wherein the first driving step is carried out in a full-screen display mode for driving all pixels, and the second driving step is carried out in a partial-screen display mode for driving a part of pixels.

5. A method of driving a liquid crystal device comprising a first substrate on which a plurality of electrodes are formed, a second substrate on which a plurality of segment electrodes are formed, and a liquid crystal interposed between the first substrate and the second substrate, and applying a voltage which changes into at least an ON voltage, an OFF voltage and an intermediate voltage therebetween in accordance with a pulse amplitude modulation to a pixel formed at each intersection point of the common electrodes and the segment electrodes, the method comprising:

a first driving step of driving the liquid crystal device under a condition of a first duty $n_1$ and a first bias ratio $c_1$; and a second driving step of driving the liquid crystal device under a condition of a second duty $n_2$ and a second bias ratio $c_2$, wherein the first and the second duties and the first and the second bias ratios are set to satisfy $n_1 \cdot c_1^2 = n_2 \cdot c_2^2$, thereby the half-tone display both in the first and second driving step become constant.

6. The method of driving a liquid crystal device according to claim 5, wherein one of the common electrodes is sequentially selected in each of the first driving step and the second driving step.

7. The method of driving a liquid crystal device according to claim 5, wherein two or more of the common electrodes are selected together in each of the first driving step and the second driving step.

8. The method of driving a liquid crystal device according to claim 7, wherein the first driving step comprises a step of raising a maximum signal potential supplied to the segment electrodes to generate a selection potential to be supplied to the common electrodes, and wherein the second driving step comprises a step of stopping the raising step and supplying the maximum signal potential supplied to the segment electrodes to the common electrodes as the selection potential.

9. The method of driving a liquid crystal device according to claim 8, wherein when a voltage-raising multiplying factor is "k" in the raising step performed in the first driving step, the relation $n_2 = n_1 \cdot (1/k)^2$ is realized.

10. The method of driving a liquid crystal device according to claim 5, wherein the first driving step is carried out in a full-screen display mode for driving all pixels, and the second driving step is carried out in a partial-screen display mode for driving a part of pixels.

11. A method of driving a liquid crystal device comprising a first substrate on which a plurality of electrodes are formed, a second substrate on which a plurality of segment electrodes are formed, and a liquid crystal interposed between the first substrate and the second substrate, and applying a voltage which changes into at least an ON voltage, an OFF voltage and an intermediate voltage therebetween in accordance with a pulse amplitude modulation to a pixel formed at each intersection point of the common electrodes and the segment electrodes, the method comprising:

a first driving step of driving the liquid crystal device under a condition of a first duty and a first bias ratio; and a second driving step of driving the liquid crystal device under a condition of a second duty lower than the first duty and a second bias ratio, wherein the first and the second duties and the first and the second bias ratios are set so that a root-mean-square voltage applied to the pixel when the ON voltage is applied to the pixel in the first driving step is equal to or less than a root-mean-square voltage applied to the pixel when the ON voltage is applied to the pixel in the second step, and a root-mean-square voltage applied to the pixel when the OFF voltage is applied to the pixel in the first driving step is equal to or more than a root-mean-square voltage applied to the pixel when the OFF voltage is applied to the pixel in the second step.

12. The method of driving a liquid crystal device according to claim 11, wherein one of the common electrodes is sequentially selected in each of the first driving step and the second driving step.

13. The method of driving a liquid crystal device according to claim 11, wherein two or more of the common electrodes are selected together in each of the first driving step and the second driving step.

14. The method of driving a liquid crystal device according to claim 11, wherein the first driving step is carried out in a full-screen display mode for driving all pixels, and the second driving step is carried out in a partial-screen display mode for driving a part of pixels.

15. A liquid crystal device comprising:

a panel including a first substrate on which a plurality of electrodes are formed, a second substrate on which a plurality of segment electrodes are formed, and a liquid crystal interposed between the first substrate and the second substrate;

a segment driver which supplies a voltage to the segment electrodes;

a common driver which supplies a voltage to the common electrodes; and a power supply circuit which supplies a liquid crystal driving voltage to the common driver and the segment driver, thereby applying a voltage which changes into at least an ON voltage, an OFF voltage and an intermediate voltage therebetween in accordance with a pulse amplitude modulation to a pixel formed at each intersection point of the common electrodes and the segment electrodes, wherein the segment driver includes a circuit of which duty changes between a first duty $n_1$ and a second duty $n_2$ ($n_2<n_1$), wherein the power supply circuit comprises a circuit which sets a bias ratio at a first bias ratio $c_1$ when the first duty $n_1$ is set, and sets a bias ratio at a second bias ratio $c_2$ when the second duty $n_2$ ($c_2>c_1$) is set, and wherein the first duty and the second duty and the first bias ratio and the second bias ratio are set to satisfy $n_1 \cdot c_1^2 = n_2 \cdot c_2^2$.

16. The liquid crystal device according to claim 15, wherein the common driver sequentially selects one of the common electrodes.

17. The liquid crystal device according to claim 16, wherein the common driver and the power supply circuit are included in a single-chip IC.

18. An electronic instrument comprising the liquid crystal device according to claim 16.

19. The liquid crystal device according to claim 15, wherein the common driver selects two or more of the common electrodes together.

20. The liquid crystal device according to claim 19, wherein the power supply circuit comprises:

a voltage raising circuit which raises the maximum signal potential supplied to the segment electrodes to generate a selection potential to be supplied to the common electrodes, a voltage raising timing circuit which causes the voltage raising circuit to operate when set to the first duty $n_1$ is set, and stops the voltage raising circuit when set to the first duty $n_2$ is set; and a potential switching circuit which supplies the maximum signal potential supplied to the segment electrodes to the common electrodes as the selection potential when set to the first duty $n_2$ is set.

21. The liquid crystal device according to claim 20, wherein when a voltage-raising multiplying factor in the voltage raising circuit is "k", the relation $n_2=n_1 \cdot (1/k)^2$ is realized.

22. The liquid crystal device according to claim 15, wherein the common driver and the power supply circuit are included in a single-chip IC.

23. An electronic instrument comprising the liquid crystal device according to claim 15.

24. The liquid crystal device according to claim 15, wherein the segment driver selects the first duty $n_1$ in the full-screen display mode for driving all pixels and the second duty $n_2$ in the partial-screen display mode.

* * * * *